US007107789B1

(12) United States Patent
Bruner

(10) Patent No.: US 7,107,789 B1
(45) Date of Patent: Sep. 19, 2006

(54) OPENABLE RING WITH COOPERATING LOCKING MEANS

(76) Inventor: Mates A. Bruner, 14 Barbara La., Havertown, PA (US) 19083

( * ) Notice: Subject to any disclaimer, the term of this patent is extended or adjusted under 35 U.S.C. 154(b) by 0 days.

(21) Appl. No.: 11/251,972

(22) Filed: Oct. 17, 2005

(51) Int. Cl.
*A44C 19/00* (2006.01)
*A44C 9/02* (2006.01)
*A44C 5/00* (2006.01)

(52) U.S. Cl. ..... 63/15.7; 63/15; 63/3.1; 63/15.3; 63/15.5; 63/7

(58) Field of Classification Search ..... 63/3.1, 63/15, 15.5, 15.3, 15.7
See application file for complete search history.

(56) References Cited

U.S. PATENT DOCUMENTS

| | | | | | |
|---|---|---|---|---|---|
| 145,788 | A | | 12/1873 | Cottle | |
| 804,137 | A | | 11/1905 | Kent | |
| 1,003,696 | A | | 9/1911 | Briggs | |
| 1,296,435 | A | * | 3/1919 | Schmidt | 63/15.5 |
| 2,045,282 | A | | 6/1936 | Metcalf | |
| 2,146,272 | A | * | 2/1939 | Skoog | 63/15.65 |
| 3,204,426 | A | | 9/1965 | Armstrong | |
| 3,221,514 | A | | 12/1965 | Newman | |
| 3,465,543 | A | | 9/1969 | Baker | |
| 3,736,770 | A | * | 6/1973 | Kelrick | 63/15.7 |
| 4,183,120 | A | * | 1/1980 | Thorne | 24/16 R |
| 4,694,664 | A | * | 9/1987 | Elsener | 63/12 |
| 4,879,883 | A | | 11/1989 | Bruner | |
| 5,136,858 | A | * | 8/1992 | Bruner | 63/15.7 |
| 5,186,023 | A | * | 2/1993 | Goldberg | 63/15.5 |
| 5,412,956 | A | * | 5/1995 | Levy | 63/15.65 |
| 6,266,852 | B1 | * | 7/2001 | Tai | 24/16 PB |
| 6,370,914 | B1 | * | 4/2002 | Bruner | 63/15.7 |
| 6,481,069 | B1 | * | 11/2002 | Cheng | 24/647 |
| 2005/0126223 | A1 | * | 6/2005 | Maschio | 63/15 |

* cited by examiner

*Primary Examiner*—Robert J. Sandy
*Assistant Examiner*—David Reese
(74) *Attorney, Agent, or Firm*—Caesar, Rivise, Bernstein, Cohen & Pokotilow, Ltd.

(57) ABSTRACT

An openable ring that is arranged to be worn about a portion of a body of a person. The ring includes first and second arcuate sections that are pivotally interconnected at one end of the ring for permitting pivotal movement of the arcuate sections between opened and closed positions. At the end opposite the pivotal interconnection, each arcuate section includes a pair of locking extensions, the locking extensions being transversely aligned with one another. Each locking extension has a locking surface which comprises a sum of more than two alternating hill and valley portions. The hill and valley portions of each respective locking surface cooperate with each other to releasably retain the arcuate sections in a closed position to define a closed ring having an inner surface and an outer surface. The inner surface defines an interior passage for receiving a portion of the person's body, e.g., a finger.

13 Claims, 3 Drawing Sheets

OPENABLE RING WITH COOPERATING LOCKING MEANS

BACKGROUND OF THE INVENTION

1. Field of Invention

This invention relates generally to ring-like objects designed to be worn as jewelry, and more particularly to rings which are enabled to be releasably opened for fitting about a portion of the wearer's body, e.g., finger, which are resistant to accidental opening, and which are easily opened when desired.

2. Description of Related Art

All references cited herein are incorporated herein by reference in their entirety.

Conventional finger rings or other jewelry arranged to be worn about a portion of the body must have a sufficient diameter to slide over the knuckle or other bony protuberance adjacent the point at which the ring is to be worn. Normally, such action does not present any problem since the difference in diameter between the bony protuberance, e.g., knuckle, and the portion on which the ring is worn is sufficiently small so that a properly fitting ring is comfortable to wear, to put on and to remove. However, there are numerous individuals who, for a variety of reasons, such as bone fractures, arthritis, etc., have enlarged knuckles or other protuberances, which prevent their wearing of conventional jewelry.

The prior art includes adjustable, expandable and openable jewelry rings. For example, some of the prior art discloses rings which are adjustable in size through a specific range. Such rings are limited to a fixed expansion and are adapted to permanently remain in one particular size. They are also generally constructed so that the can expand only to a limited degree, thus limiting the size of a knuckle or other protuberance over which they may be fit.

The prior art also discloses openable rings having exposed latching members that easily can be opened by a person's finger, to thereby permit repeated opening of the ring. Because these rings have exposed latching members that are designed to be opened by the modest downward force imparted by a person's finger, they inherently lack the desired durability and safety against self-opening.

There are a variety of other openable ring constructions which have been disclosed in the prior art. A number of the ring constructions employ, as part of the locking or latching system, a separate spring member. The use of a separate spring can increase the fabrication and material costs of the ring, since the spring element is made separate from the ring, and then needs to be affixed to the remainder of the ring structure. In addition, resilient spring members often tend to lose their resiliency, and in prior art constructions employing such spring members, a loss of resiliency may adversely affect the locking capabilities of the construction.

In a variety of prior art structures the latching mechanisms are quite bulky and unsightly, and therefore are not readily adaptable for use on high quality jewelry made of precious metals, such as gold and platinum. Still other latching assemblies constitute a point of weakness which is readily susceptible to being deformed under bending stresses of the type which normally are encountered by the wearer of the ring. Still other prior art structures are somewhat difficult to use, requiring substantial manual dexterity in order to properly close the ring, and, when desired, to open the ring.

Examples of prior art adjustable or openable ring-like jewelry are found in Netherlands Patent No. 87,327 (Goldbach); French Patent No. 75 07499 (Algier); and the following U.S. Pat. No. 145,788 (Cottle); U.S. Pat. No. 804,137 (Kent); U.S. Pat. No. 1,003,696 (Briggs); U.S. Pat. No. 1,296,435 (Schmidt); U.S. Pat. No. 2,045,282 (Metcalf); U.S. Pat. No. 3,204,426 (Armstrong); U.S. Pat. No. 3,221,514 (Newman); U.S. Pat. No. 3,465,543 (Baker); U.S. Pat. No. 3,736,770 (Kelrick), U.S. Pat. No. 4,879,883 (Bruner), U.S. Pat. No. 5,136,858 (Bruner) and U.S. Pat. No. 6,370,914 (Bruner).

In U.S. Pat. No. 5,136,858, (Bruner), which is hereinafter referred to as the '858 patent and of which I am the sole inventor, and the disclosure of which is incorporated herein by reference, there is disclosed and claimed an openable ring which overcomes many of the drawbacks of the prior art openable rings. The '858 openable ring has many advantages over the prior art, including, but not limited to: (1) protection against inadvertent opening; (2) no reliance on external spring elements to provide a locking function; (3) use of the inherent spring tension of the material of the ring to assist in maintaining the ring in a closed, or latched condition; and (4) despite openability, it is aesthetically pleasing, without any unsightly bulging and/or projecting elements.

U.S. Pat. No. 6,370,914 (Bruner), which is hereinafter referred to as the '914 patent and of which I am the sole inventor, and the disclosure of which is incorporated herein by reference, discloses and claims an openable ring. The '914 patent discloses an alternative design of the locking extensions described in the '858 patent which enable users of rings having greater thicknesses and widths to close the rings with less force. A ring according to the '914 patent thus possesses the advantages of a ring according to the '858 patent, with the added benefit that it allows rings having greater thicknesses and widths to close and lock with greater ease.

The '858 and '914 patents were, without a doubt, innovations in the jewelry arts. The openable ring disclosed in the '858 patent has been on the market for well over a decade and has enjoyed much success. Over this period of time, I, as inventor of the '858 and '914 patents have received feedback from customers and jewelers regarding my rings. From this feedback as well as my own experience, I have determined that there are certain needs that should be addressed by a new openable ring. In particular, there is a need for an openable ring comprising a locking mechanism that more effectively distributes stress and has greater durability—one that will prevent wear and tear and thus better stand the test of time. A new ring design is needed to address the problem of skin pinching, which some ring users have experienced. There is a need for a stronger interlock between the locking extensions that is more reliable, and which will give the user greater peace of mind that the ring will not open inadvertently. Additionally, an audible indication of locking is needed which provides the user with greater confidence that the ring is securely locked. Also, an openable ring which opens in a more controlled, gradual fashion is needed to ensure maximum safety against accidental opening. Furthermore, there is a need for an openable ring which is easier to manufacture. It would be optimal if the new openable ring could have such advantages without requiring additional components.

BRIEF SUMMARY OF THE INVENTION

The present invention addresses the needs discussed above. In accordance with the present invention, an openable ring that is arranged to be worn about a portion of a body of a person is disclosed. The ring includes first and second arcuate sections that are pivotally interconnected at one end of the ring for permitting pivotal movement of the arcuate sections between opened and closed positions. At the end opposite of the pivotal interconnection, each arcuate section includes a pair of locking extensions. The locking extensions cooperate with each other to releasably retain the arcuate sections in a closed position to define a closed ring having an inner surface and an outer surface. The inner surface defines an interior passage for receiving a portion of the person's body, e.g., a finger. Each locking extension on the first arcuate section is transversely aligned with a respective locking extension on the second arcuate section. The locking extension on the first arcuate section has a locking surface, which is opposite the inner surface. The locking surface has a sum of more than two alternating hill and valley portions. The locking extension on the second arcuate section also has a locking surface, which is opposite the outer surface. This locking surface also has a sum of more than two alternating hill and valley portions. When the ring is in its closed position, the hill and valley portions of the locking surfaces meet in a locking engagement.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
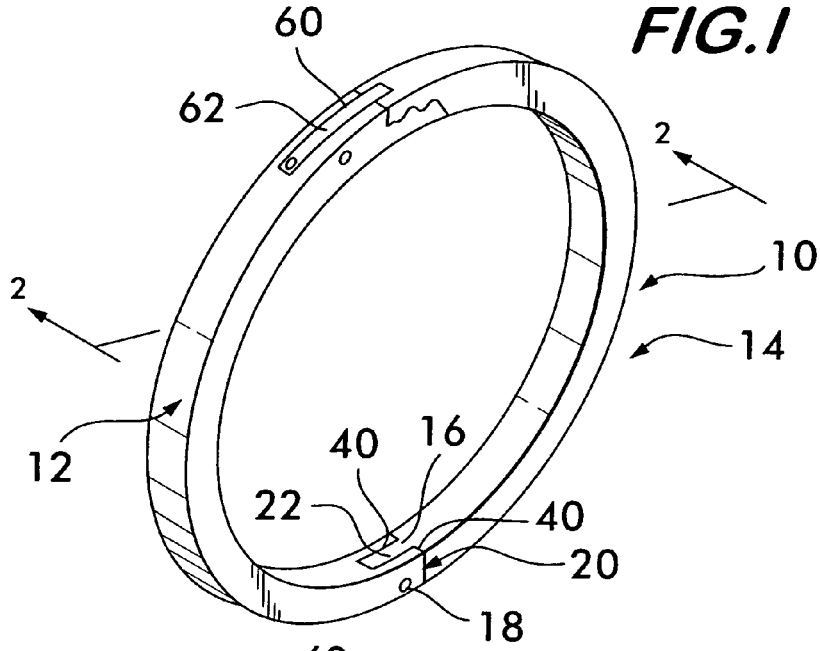
FIG. 1 is an isometric view of the ring of this invention in its closed position.

Referring now to the various figures wherein like reference characters refer to like parts, an openable ring with a latch mechanism is generally shown at 10 in FIG. 1. The device 10 basically comprises a pair of arcuate sections 12 and 14 pivotally interconnected through a hinge connection 16 adjacent one of their contiguous ends, and including a latch mechanism 60 adjacent their opposite contiguous ends.

Figure 2:
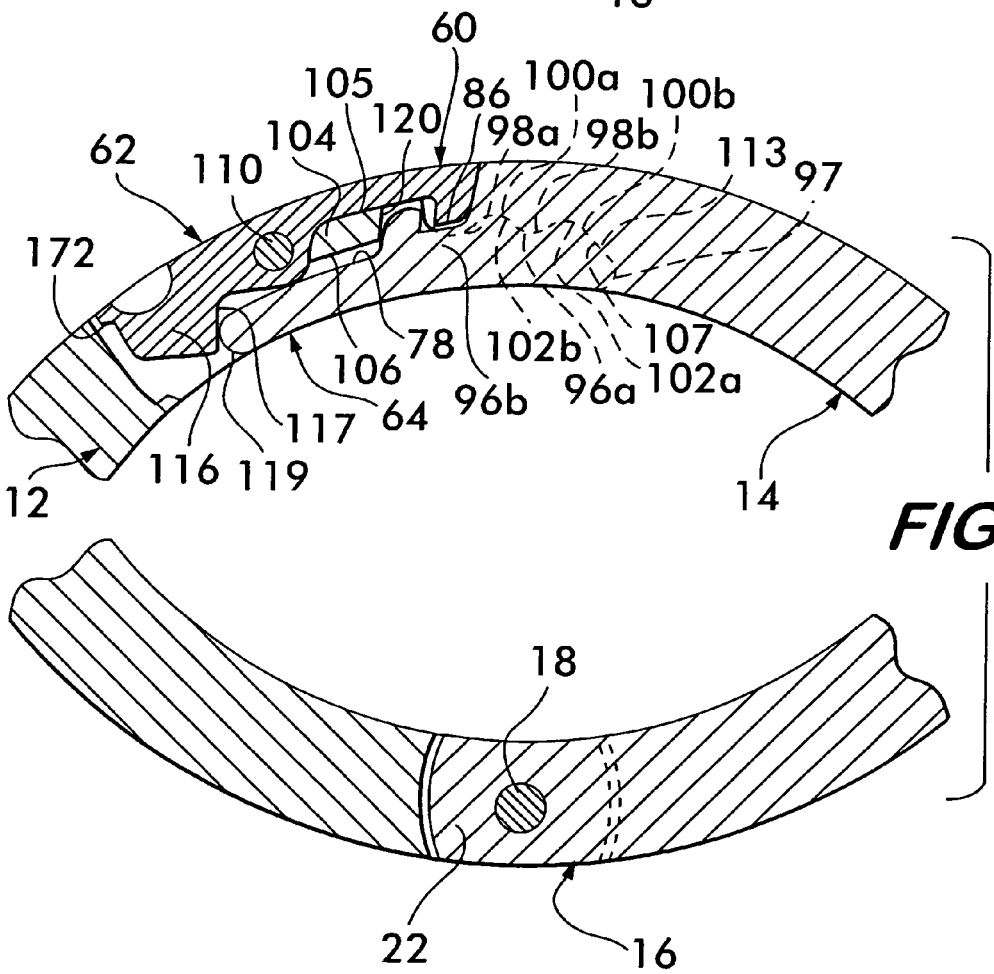
FIG. 2 is a fragmentary sectional view taken along line 2—2 showing the arrangement of the openable ring having unique cooperating hill and valley portions of the invention in the closed position.

Referring to FIGS. 1 and 2, the hinge connection 16 includes a hinge pin 18 extending through aligned openings in yolk 20 of section 12 and tang 22 of section 14. At this point it should be noted that the ring sections 12 and 14 are preferably made of a precious metal, e.g., gold, silver or platinum, and are formed from wax impressions of the ring sections in a conventional investment casting operation. Yoke 20 also includes leg sections 40. The details of the construction and operation of the hinge connection are set forth in detail in U.S. Pat. No. 5,136,858, which is incorporated herein by reference.

It should be noted that, in the preferred use of the ring 10, the arcuate section 14 constitutes the upper section of the ring, and the arcuate section 12 constitutes the bottom section of the ring. Thus, the hinge connection 16 and the latch mechanism 60 are located in a plane which generally passes through the wearer's fingers (e.g., in a plane substantially perpendicular to the front and back surfaces of the wearer's hand).

In the preferred embodiment of the invention the pivot pin 18 is riveted to the arcuate sections 12 and 14, by employing riveting rolls of the type manufactured by the Grant Manufacturing and Machine Company of Bridgeport, Conn. The use of these riveting rolls provides a non-obtrusive appearing, rigid connection which is particularly important in the formation of high quality rings made from gold and/or other precious metals.

Referring to FIGS. 2–5, the latch mechanism 60 includes a safety latch 62 which is automatically moved into a locked position as the ring is moved into a closed position. The safety latch 62 also functions as a release mechanism for assisting in the opening of the ring, when it is desired to remove the ring from a person's finger.

As will be explained in greater detail hereinafter, the latch mechanism 60 employs a joint arrangement to maximize resistance against bending stresses, without the use of separate spring members. The latch mechanism 60 of this invention relies for its operation on the inherent spring tension within each of the arcuate sections 12 and 14; not upon the use of separate spring members which may fail in operation and which can add additional fabrication and material costs to the ring.

Figure 4:
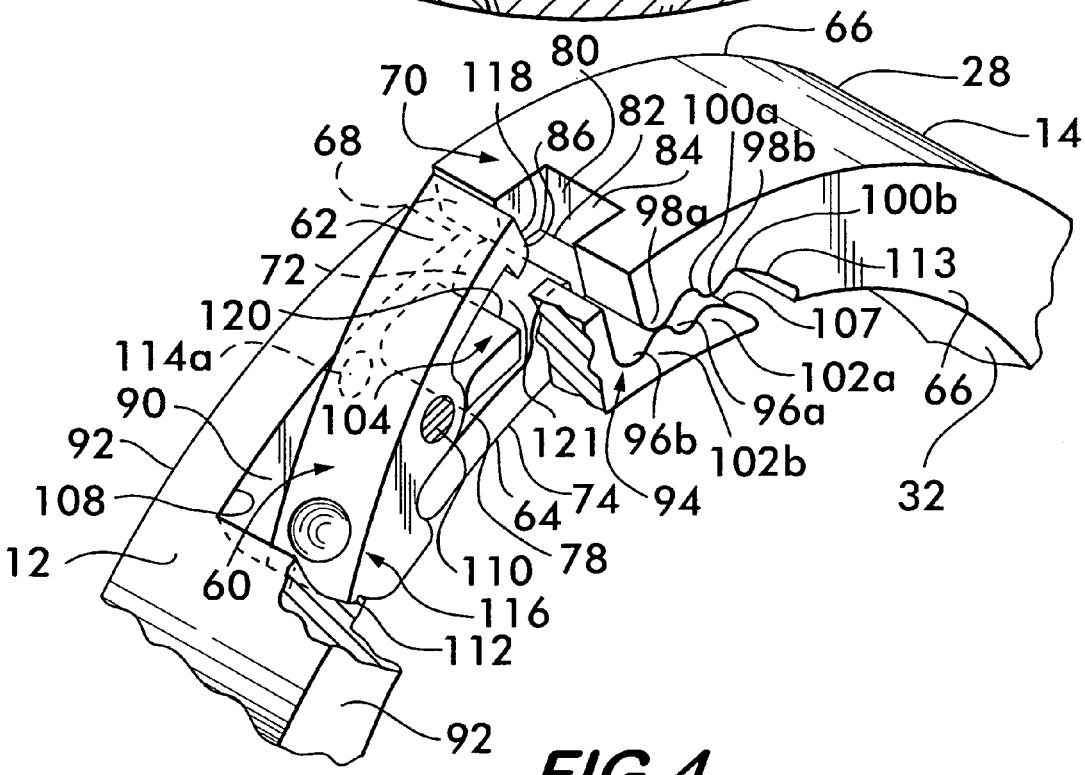
Figure 5:
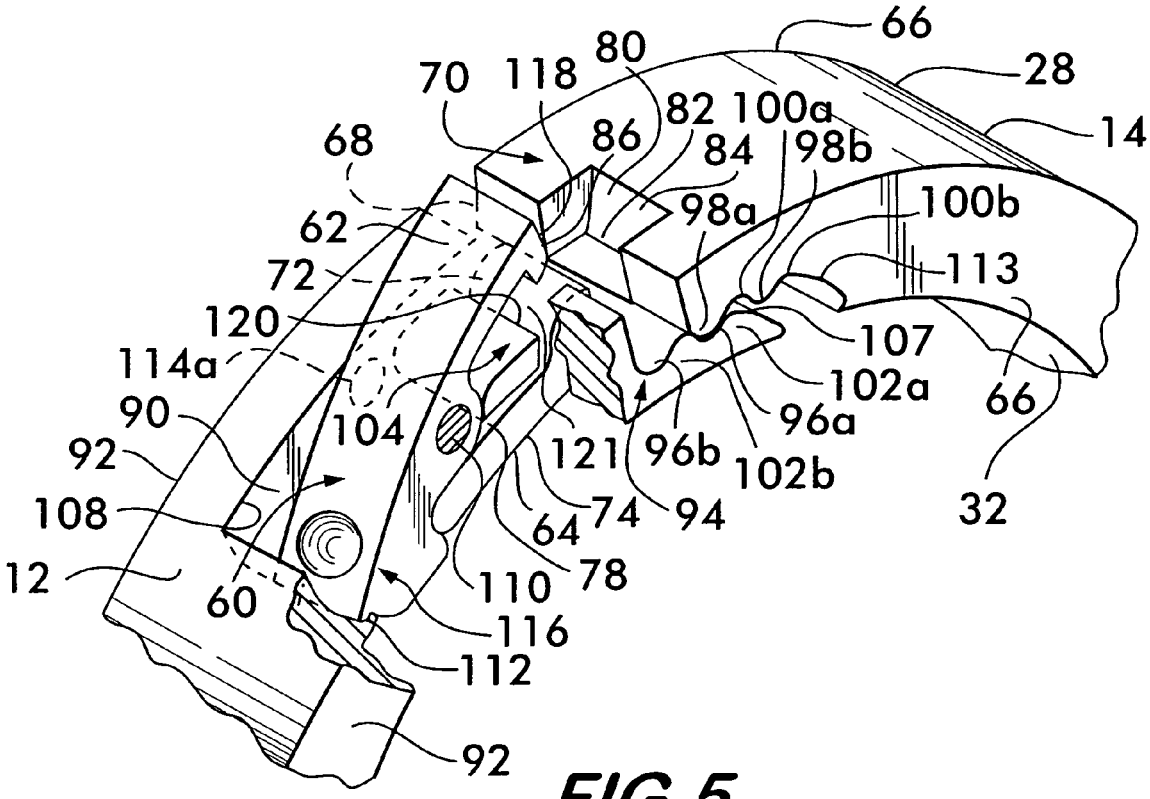
FIG. 5 is a fragmentary, exploded isometric view showing the ring in its partially disengaged, "resting position."

As can be seen best in FIGS. 4 and 5, the latch mechanism 60 includes an elongate tongue 64 located centrally between sidewalls 66 of the arcuate ring section 14. The tongue 64 extends distally beyond end walls 68 of locking extensions 70 that straddle the tongue 64.

Still referring to FIGS. 4 and 5, the tongue 64 has a raised shoulder 72 adjacent a proximal end thereof. The inner surface 74 of the tongue has substantially the same radius of curvature as inner surface 32 of the ring section 14, to thereby provide a substantially continuous smooth extension of said inner surface 32. Since the tongue 64 is not as thick as the main body of the ring section 14, its outer surface 78 is spaced inwardly of the outer surface 28 of the main body of said ring section.

Referring to FIGS. 4 and 5, a transition surface 80, constituting the proximal end of the outer surface 78 of the tongue, actually meets with the outer surface 28 of the main body portion of the ring section 14. A proximally facing surface 82 (FIGS. 4 and 5) of the shoulder 72 cooperates with the transition surface 80 to provide a recessed region 84 into which an inwardly directed nib 86 at the distal end of the safety latch 62 seats, when the ring is in a closed and locked condition (FIG. 2).

Referring to FIGS. 4 and 5, the distal end of the ring section 12, includes a generally U-shaped recess 90 located centrally between outer side surfaces 92, to thereby provide transversely spaced-apart locking extensions 94. These locking extensions are aligned to cooperate with the locking extensions 70 provided on a contiguous end of the arcuate ring section 14 in a manner to be described below in accordance with the present invention.

Still referring to FIGS. 4 and 5, each of the locking extensions 94 of arcuate section 12 includes outwardly facing hill portions 102*a* and 102*b* and valley portions 96*a* and 96*b*. Likewise, each of the locking extensions 70 of arcuate section 14 includes inwardly facing valley portions 100*a* and 100*b* and hill portions 98*a* and 98*b*. As shown in FIGS. 1 and 2, when the ring is in its fully closed and locked position, hill portion 102*a* engages with valley portion 100*b*, hill portion 98*b* engages with valley portion 96*a*, hill portion 102*b* engages with valley portion 100*a*, and hill portion 98*a* engages with valley portion 96*b*. The hill and valley configuration of the locking extensions 70 and 94 (FIGS. 4 and 5) provides a strong interlock, giving the user greater assurance that the ring 10 will not inadvertently disengage. Additionally, the unique configuration of the locking extensions 70 and 94 distributes stress over a greater area, rendering the locking extensions 70 and 94 more durable. Thus, over time, the locking extensions 70 and 94 of the present invention will experience significantly less wear and tear than the prior art locking extensions.

As an additional benefit, the hill and valley configuration of the locking extensions 70 and 94 (FIGS. 4 and 5) is easier to manufacture than the configuration of the locking extensions disclosed in the '858 and '914 patents. The complementary surfaces of the locking extensions of the rings disclosed in the '858 and '914 patents are significantly smaller than are the surfaces of locking extensions 70 and 94 according to the present invention. It is difficult and time-consuming for a technician to machine the desired geometry into the small surfaces of the locking extensions of the '858 and '914 patents. Additionally, technicians spend much time calibrating the rings of the '858 and '914 patents, such that the locking extensions would mate properly. Since the surfaces of the locking extensions 70 and 94 of the present invention have a larger workable area, they may be manufactured using the much easier casting method, rather than having to be individually machined like the locking extensions of the '858 and '914 patents. Moreover, the larger surface areas of the locking extensions 70 and 94 of the present invention allow for an easier and less time-consuming calibration of the ring 10 in order for the locking extensions 70 and 94 to mate properly.

The hill and valley configuration of the locking extensions 70 and 94 provides the user with ease and control in closing the ring 10. As best shown in FIG. 2, when the locking extensions 70 and 94 are in their completely closed and locked position, all hill portions 102*a*, 102*b*, 98*a* and 98*b* are engaged with respective valley portions 100*a*, 100*b*, 96*a*, and 96*b*, in the manner explained supra. On the other hand, the locking extensions 70 and 94 are considered to be fully disengaged when they are not at all in contact with one another (not shown).

As can be seen in FIGS. 2–5, hill portion 102*a* includes on its distal side both a slightly inclined ramp section 107 and a distal rounded edge 97. As best shown in the figures, the ramp section 107 is substantially flat over its length and inclines gradually. The configuration of the hill portion 102*a* enables the ring 10 to close with minimal force. In particular, when the user compresses the arcuate sections 12 and 14 together, initial contact is made by the locking extensions thereof 70 and 94. Upon initial contact, the distal end of hill portion 98*a* of arcuate section 14 gradually rides up the long linear distance of the inclined ramp section 107. As the locking extensions 70 and 94 become further engaged, the respective peaks of hill portions 102*a* and 98*a* contact one another (not shown). Subsequently, hill portion 98*a* slides into engagement with valley portion 96*a*, as shown in FIG. 5. This simultaneous transition causes an audible "snap." In this configuration, the locking extensions 70 and 94 are in their partially engaged, resting position.

Figure 3:
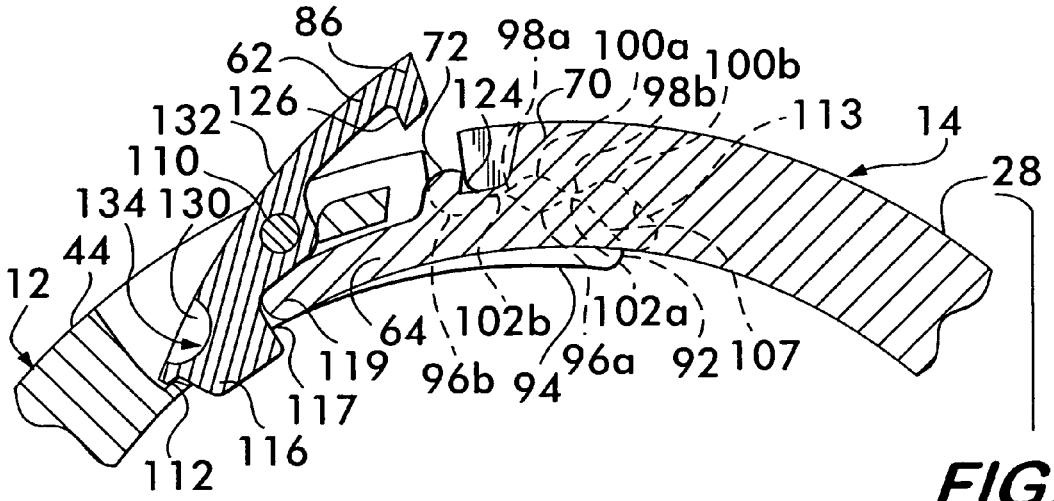
FIG. 3 is a sectional view similar to FIG. 2, but showing the arrangement of the openable ring having unique cooperating hill and valley portions after the latch mechanism has been depressed to open the arcuate sections; and, FIG. 4 is a fragmentary, exploded isometric view showing details of the latch mechanism having unique cooperating hill and valley portions of this invention.

As arcuate sections 12 and 14 are compressed further together, the locking extensions 70 and 94 contact one another at respective peaks of hill portions 102*b* and 98*a*, as shown in FIGS. 3 and 4. Thereafter, as the locking extensions 70 and 94 are moved into their fully closed and locked position as shown in FIG. 2, the movement creates a second audible "snap." Thus, when a user adjusts the ring 10 from the fully disengaged position to the completely closed position, engagement of the locking extensions 70 and 94 creates an audible "double snap," making the user confident that the ring 10 is securely closed and locked. As shown in FIGS. 2–5, valley portion 100*b* includes a substantially flat and slightly sloping section 113. This section 113 receives the inclined ramp section 107 of hill portion 102*a*, when the locking extensions 70 and 94 are in their fully closed and locked position (FIG. 2).

Alternative embodiments of the present invention (not shown) may include additional hill and valley portions on the locking extensions 70 and 94. If, for example, the locking extensions 70 and 94 were to each have three hill portions and three valley portions, the closing and locking of the ring 10 would create an audible "triple snap."

It should be noted that with the ring in a completely closed position, the confronting surfaces of the locking extensions 70 and 94 are in engagement with each other to provide smooth, aesthetically pleasing outer side surfaces of the ring 10 (see FIGS. 1 and 2). In accordance with the present invention, the preferred embodiment as shown in FIG. 1 may be of any suitable inner diameter, e.g., between a ring size of 2.5 to any desired ring size; may be of any suitable thickness, e.g., between approximately 2.0 millimeters and 4.0 millimeters; and, may be of any suitable width, e.g., between 2.5 and 14 millimeters.

Referring to FIGS. 2, 4 and 5, a transversely extending bridge section 104 constitutes a part of the latch mechanism 60 and is unitarily formed between the locking extensions 94 of the arcuate section 12. This bridge section adds rigidity to the system, by actually-providing a brace between the locking extensions. In addition, as can be seen best in FIG. 2, an upper surface 105 of the bridge section provides a support for the safety latch 62 when the safety latch is in a ring-locking position.

As can be seen best in FIG. 2, the bridge section 104 also includes a lower surface 106. This lower surface, in conjunction with inner side surfaces of the recess 90 define a channel for receiving the elongate tongue 64 therein (see FIGS. 4 and 5). In addition, it should be noted that the lower surface 106 of the bridge section (FIG. 2) is spaced from the upper surface 78 of the elongate tongue 64 when the ring is in a closed position. The location of the bridge section 104 and tongue 64 to provide this spacing is required, to thereby permit relative radial movement to take place between the arcuate sections 12 and 14, for permitting the valley portions 96*a* and 96*b* and hill portions 102*a* and 102*b* of locking extensions 94 to "double snap" into locking engagement with complementary shaped hill portions 98*a* and 98*b* and valley portions 100*a* and 100*b*, respectively, of the locking extensions 70. Since the space between the lower surface 106 of the bridge section and the upper surface 78 of the tongue 64 is located in the interior of the ring, it is not visible, and therefore does not detract from the aesthetically pleasing appearance of the ring construction.

Referring to FIGS. 2, 4 and 5, a pivot pin 110 of the safety latch 62 is located intermediate the inwardly directed nib 86 at the distal end of the latch, and an inwardly directed shoulder 112 of a nib located at the proximal end of the latch. The pivot pin 110 extends through an opening (not shown) provided through one of the locking extensions 94, and into an aligned, blind opening 114*a* extending only partially through the other of said extensions, from the inner side surface 108 thereof (FIGS. 4 and 5). Thus, an end surface of the pivot pin 110 is only visible from one side of the ring, and the base of the blind opening 114*a* provides a surface for properly locating the pin relative to the other components of the ring.

Referring to FIGS. 2, 4 and 5, the safety latch 62 includes an inwardly projecting section 116 adjacent the proximal end 112 thereof. This inwardly projecting section 116 includes a generally distally facing surface 117 that cooperates with distal end 119 of the tongue 64, to automatically pivot the safety latch 62 in a clockwise direction, as viewed in FIG. 2, into the closed and locked position shown in FIG. 2.

Specifically, as the ring 10 is moved from its opened position, as is seen best in FIGS. 3 and 4, into the closed position shown in FIG. 2, the distal end 119 of the tongue 64 engages the surface 117 of inwardly projecting section 116, causing the safety latch to rotate in a clockwise direction. Continuous movement of the ring sections into a closed position imposes a slight inwardly radial force on the tongue 64, causing the inherent spring tension within the tongue to impose an opposite, outward radial force on the inwardly projecting section 116 of the safety latch 62. In view of the fact that the inwardly projecting section 116 is located to the left of the pivot pin 110, as is viewed in FIGS. 2 and 3, this outward, radial force maintains the safety latch 62 in its locked condition. When the safety latch 62 is in this locked condition, distal surface 118 of the safety latch 62 is biased into a position closely adjacent the transition surface 80 located proximal of the shoulder 72 of the tongue 64 (see FIGS. 2–5). This provides a generally aesthetically pleasing outer surface appearance, and generally eliminates exposed edge surfaces to irritate the finger adjacent the ring finger.

In the closed position of the latch 62 (see FIG. 2), distally-facing surface 120 of the bridge section 104 is contiguous to a distally-facing surface segment 121 of the raised shoulders 72 (see FIGS. 3 and 4). In fact, in the preferred construction, the spacing between these latter surfaces 120, 121 is on the order of 0.002 inches. It should be noted that the force biasing the safety latch into a closed position, resulting from the engagement of tongue 64 with the projecting section 116, is continuously maintained during a portion of the counterclockwise rotational movement of the safety latch in the direction of arrow 134 (FIG. 3). This arrangement precludes inadvertent opening of the safety latch 62, in that any slight, inadvertent, counterclockwise movement of the safety latch, in the direction of arrow 134, will not automatically open the safety latch. In fact, once the pressure or force is released, the normal spring tension imposed upon the projecting section 116, by the tongue 64 will automatically snap the safety latch back into its locking position. In other words, the cam arrangement provided by the interaction of the tongue 64 with the projection 116 will trigger an opening action at a depth of counterclockwise rotation, which only can be reached by the use of a separate implement, such as a pen or pencil, as will be described hereinafter.

Referring to FIGS. 2 and 3, when the safety latch 62 is in a closed condition a proximal-facing surface 124 of raised shoulder 72 of the tongue 64 is in radial overlapping relationship with a proximal-facing surface 126 of the inwardly directed nib 86 of the safety latch 62. The inherent spring tension of tongue 64 biases the safety latch 62 into a position wherein the radially overlapping surfaces 124 and 126 are circumferentially spaced from each other. However, in the event that some of the "springiness" of the tongue 64 becomes degraded, thereby permitting some separation of the arcuate sections 12 and 14, the overlapping surfaces 124 and 126 will engage each other, to thereby preclude the inadvertent opening of the ring sections.

Although the safety latch 62 provides an extremely reliable locking function, the safety latch is capable of automatically moving into an opened position, in the event that any excessively high, abrupt, pulling force or pressure is imposed upon the ring, to thereby prevent serious injury to the wearer's finger. In fact, the sudden surge of a pulling force or pressure will trigger an opening of the ring, like a safety fuse that explodes under a surge of excess energy.

Referring specifically to FIG. 3, the proximal end 112 of the safety latch 62 includes a small diameter recess 130 provided in outer surface 132 thereof. This small diameter recess is adapted to receive a small instrument (e.g., the point of a pen or pencil) therein, to provide a counterclockwise latch opening force on the safety latch 62, in the direction of arrow 134, as viewed in FIG. 3.

Referring to FIG. 3, it should be noted that the outer surface 132 of the safety latch 62 has a radius of curvature generally corresponding to the radius of curvature of the outer surfaces 44 and 28 of arcuate sections 12 and 14, to thereby provide, in cooperation with the arcuate sections, a substantially continuous curved outer surface when the ring is closed.

Referring to FIG. 3, proximally facing surface 117 of the inwardly projecting section 116 engages the distal end 119 of tongue 64, to thereby force the tongue in a direction to the right (as viewed in FIG. 3) for partially disengaging the interconnection between locking extensions 70 and 94. The partially disengaged, resting condition of locking extensions 70 and 94 is illustrated in FIG. 5, wherein valley portion 96*a* is engaged with hill portion 98*a*. Thereafter, arcuate sections 12 and 14 can be easily gripped by the wearer of the ring 10 to complete the ring-opening operation. Thus, to open the ring 10, the user must perform the following two deliberate actions: (1) depress the safety latch 62 to release the locking extensions 70 and 94 into their partially disengaged, resting position, as shown in FIG. 5; and (2) manually pull arcuate sections 12 and 14 apart from the partially disengaged position of locking extensions 70 and 94, to a fully disengaged position, at which point the user may remove the ring 10. This novel design allows the user to open the ring 10 in a controlled fashion, which protects against accidental opening and skin pinching. Therefore, this novel design gives the user confidence that the ring will open only when the user wants it to open.

While the invention has been described in detail and with reference to specific examples thereof, it will be apparent to one skilled in the art that various changes and modifications can be made therein without departing from the spirit and scope thereof.

What is claimed is:

1. An openable ring arranged to be worn about a portion of a body of a person, said ring comprising:

a. first and second arcuate sections pivotally interconnected at one end of said ring for permitting pivotal movement of said arcuate sections between opened and closed positions, said arcuate sections also having a second end opposite the pivotal interconnection;

b. a locking surface disposed on each arcuate section at said second end, each said locking surface provided for cooperating with a locking surface of the other arcuate section for releasably retaining the arcuate sections in a closed position;

c. said locking surface on said first arcuate section comprising a first hill portion, a second hill portion and a valley portion disposed therebetween, said valley portion being formed of a solid surface;

d. said locking surface on said second arcuate section comprising a first hill portion, a second hill portion and a valley portion disposed therebetween, said valley portion being formed of a solid surface;

e. said ring in its closed position comprising the locking engagement of said hill and valley portions of said locking surfaces;

f. said hill and valley portions being substantially curved over their respective lengths;

g. in response to actuating a latch mechanism disposed on said ring, said ring being movable from said closed position to a partially disengaged, resting position wherein said first hill portion of said second arcuate section rests within said valley portion of said first arcuate section;

h. said ring being movable from said partially disengaged, resting position to a fully disengaged position wherein said locking surfaces do not contact one another.

2. The openable ring of claim 1 wherein said locking engagement resists pivotal movement of said arcuate sections.

3. The openable ring of claim 1 wherein the thickness of said ring is between approximately 2 and 4 millimeters and the width is between 2.5 and 14 millimeters.

4. The openable ring of claim 1 wherein said ring is made of a precious metal.

5. The openable ring of claim 1 wherein said ring is made primarily of a material from the group consisting of: gold, silver and platinum.

6. The openable ring of claim 1 wherein the inner diameter of said ring is at least a ring size of 2.5.

7. The openable ring of claim 1 wherein said closed position is non-adjustable preventing any further movement of said arcuate sections past said closed position.

8. The openable ring of claim 1 wherein said locking surface on said first arcuate section comprises two hill portions and two valley portions.

9. The openable ring of claim 1 wherein said locking surface on said second arcuate section comprises two hill portions and two valley portions.

10. The openable ring of claim 1 wherein movement of said ring from its disengaged position to its closed position automatically causes said latch mechanism to move into a closed position.

11. The openable ring of claim 1 wherein said latch mechanism does not comprise a separate spring member.

12. The openable ring of claim 1, said ring in its closed position having an inner surface defining an interior passage for receiving said portion of a body of a person and an outer surface.

13. The openable ring of claim 12 wherein said latch mechanism is flush with said outer surface of said ring when said ring is in its closed position.

* * * * *